US005345799A

United States Patent [19]

Miodushevski et al.

[11] Patent Number: 5,345,799

[45] Date of Patent: Sep. 13, 1994

[54] METHOD AND DEVICE FOR FORMING VARIOUS WORKPIECES

[75] Inventors: Pavel Miodushevski; Oleg Sosnin, both of Moscow; Galina Rajevskaya, Novosibirsk, all of U.S.S.R.

[73] Assignee: Aliteco AG, Zug, Switzerland

[21] Appl. No.: 973,104

[22] Filed: Nov. 6, 1992

[30] Foreign Application Priority Data

Jun. 22, 1992 [EP] European Pat. Off. ..... 92110480.8

[51] Int. Cl.[5] ..... B21D 11/00

[52] U.S. Cl. ..... 72/19; 72/295; 72/342.6

[58] Field of Search ..... 72/19, 38, 295, 296, 72/342.1, 342.6, 342.94, 364, 379, 297

[56] References Cited

U.S. PATENT DOCUMENTS

| | | | |
|---|---|---|---|
| 2,737,224 | 3/1956 | Jones | 72/296 |
| 2,850,071 | 9/1958 | Kraybill | 72/297 |
| 3,739,617 | 6/1973 | Stejskal . | |
| 3,745,805 | 7/1973 | Gauthier | 72/364 |
| 4,212,188 | 7/1980 | Pinson . | |
| 4,592,537 | 6/1986 | Pfaffmann . | |

FOREIGN PATENT DOCUMENTS

| | | | |
|---|---|---|---|
| 2432929 | 1/1975 | Fed. Rep. of Germany . | |
| 3124514 | 1/1983 | Fed. Rep. of Germany . | |
| 3245755 | 6/1984 | Fed. Rep. of Germany . | |
| 56738 | 3/1986 | Japan | 72/342.94 |

*Primary Examiner*—Lowell A. Larson
*Attorney, Agent, or Firm*—Townsend and Townsend Khourie and Crew

[57] ABSTRACT

A method of manufacturing workpieces (6) and a device for effecting the same are related to the field of plastic metal working and can be used in the machine building industry. In order to improve the precision and strength of the workpieces (6) and to extend their service life, the workpiece blank is subdivided into heating zones, loading zones and cooling zones. The number of deforming steps is determined, the workpiece (6) is deformed under creeping conditions with stresses below the limit of elasticity, and, to avoid irreversible deformations, the stresses are relaxed. For this purpose, the thermal chamber (1) is provided with a multisectional housing (7) which has its sections (8) connected pivotally with each other where each section (8) has its own heater (2) and cooler (9), and within each of the zones a portion of the workpiece blank (6) is to be positioned which has the same geometrical and thermal physical properties throughout it.

15 Claims, 10 Drawing Sheets

METHOD AND DEVICE FOR FORMING VARIOUS WORKPIECES

BACKGROUND OF THE INVENTION

The present invention relates to plastic metal working and can be used in the machine building industry for the manufacture of workpieces from sheets, sections, and monolithic and welded panels forming a working surface of single or double curvature. A method is well known in prior art to be used for forming a workpiece under conditions when its material creeps (see, for instance, U.S. Pat. No. 3,739,617). A blank is placed on a heated die and pressed thereto over the entire surface thereof by means of a diaphragm. Then the die is heated uniformly so that it reaches a predetermined temperature. The blank is loaded by blowing air into the diaphragm (i.e., by differential pressure) so as to pressurize the diaphragm continuously over the entire surface of the blank until it fits completely the die.

However, when such forming is effected in accordance with this method of prior art knowledge by applying a uniform force (caused by the pressure built up in the diaphragm), a number of various deformations cannot be realized as necessary for producing the workpieces having complicated configurations. A continuous uniform force applied to the blank fails to ensure high precision of the finished workpiece when it is made from a blank having different rigidities within various portions thereof. Because of the uniform continuous heating of the die, some portions of the blank, if it has variable thickness and rigidity, can get heated up unevenly—a factor which is detrimental to the accuracy of the finished workpiece and which increases the additional stresses. For these reasons, it is impossible to obtain such strength characteristics of the workpiece material that are high enough, since the stresses emerging in the processes of straining may be higher than the limit of elasticity for this material so that plastic fractures may result which lead to a reduction in the strength properties of the workpiece material.

Also, another method is well known in prior art to be used in accordance with Inventor's Certificate Specification Serial No. 1147471, Int. Cl. B21D 11/20, wherein a blank is fixed in a plurality of points by means of movable rods arranged to be disposed coaxially with each other, then heated up to a predetermined temperature and deformed by moving the rods. This ensures the deformation of metal around the contour defined by the end faces of the stationary rods arranged to be disposed on the side of the workpiece bottom surface.

However, when such forming is effected in accordance with this method of prior art knowledge, the force applied to the fixed points of the workpiece throughout the entire process of deformation does not allow to realize a number of various deformations as necessary for producing the workpieces having complicated configurations. The deviation from the predetermined configuration seems to increase also due to the fact that it is actually impossible to make an exact allowance for the springing action since there are differences both in the geometrical parameters and in the thermal physical properties between various portions of the blank, i.e., the optimum conditions of deformation are not observed within some portions thereof—a factor which contributes to a reduction in the precision of forming as well as in the quality of the workpiece and its strength properties.

The method as taught by Inventor's Certificate Specification Serial No. 1147471 is essentially the nearest one to the method now claimed as far as the material features thereof and the useful results attainable are concerned so that it is, therefore, this particular method that has been selected by us to be the most representative one of the state of prior art.

SUMMARY OF THE INVENTION

It is an object of the present invention to improve the precision of forming the workpieces from flat blanks having a complicated relief of their surface as well as to improve their strength and service life by ensuring that the micro structure thereof is intact when irreversible deformations are made. This purpose is attained by the method of forming a workpiece from a flat blank or a curvilinear blank, wherein it is heated up and loaded under creeping conditions, said method being characterized in that said blank has the surface thereof subdivided into loading zones, heating zones and cooling zones so that the loading zones are selected therewith depending upon the homogeneity of geometrical parameters and mechanical properties for every particular portion of said blank, whereas the heating zones and the cooling zones are selected depending upon the homogeneity of geometrical parameters and thermal physical properties of every particular portion of said blank. For every such zone its maximum value of deformation $\epsilon_{max}$ is then determined depending upon the configuration of the finished workpiece in this particular zone. In addition to this, the maximum allowable deformations at a predetermined temperature, $\epsilon_e$, is determined thereupon, and the value of the latter is used for determining the allowable displacements of the loading points within the boundaries of every loading zone. Then, the number of blank deforming steps is determined from the ratio of $$\frac{\epsilon_{max}}{\epsilon_e},$$

whereupon the blank is heated until a predetermined distribution of temperatures is reached within every such zone and then cooled down to have the unevenness of heating density smoothed out. After this, the blank is deformed step by step, the rate of deforming being varied at every step both by heating and by loading under creeping conditions below the limit of elasticity. During temperature strain, the rate of deforming $\epsilon_T$ is varied in proportion to the value of $e^{\alpha T}$, whereas during loading the rate $\epsilon_H$ of deformation is varied in proportion to the value of $k\delta^m$, whereas under the combined influence of heating and loading the deformation rate $\epsilon$ is varied in proportion to the value of $e^{\alpha T}. k\delta^m$, where e=natural logarithm base; $\alpha$=coefficient depending upon the properties of the material used; T=heating temperature; k=coefficient of proportionality; $\delta$=deformation stress; and m=exponent of power.

At the end of every step, for each zone the value of force is established which gets relaxed down to its minimum value, and at the end of the last step it gets relaxed down to zero. In doing so, in the process of relaxation the geometrical dimensions are maintained as obtained at this particular step of deforming the blank, and after the last step the blank is subjected to heat treatment and to artificial aging by cooling it down so that the resulting geometrical dimensions are maintained the same, said dimensions being those ones from which a judgment can be made that the predetermined contour of the workpiece is ready.

BRIEF DESCRIPTION OF THE DRAWINGS

The method as claimed in accordance with the present invention will be discussed hereinbelow in greater detail with reference to accompanying drawings Nos. 1, 2, 3, 4, 5, 6, 7, 8, 9 and 10 illustrating a particular embodiment thereof, wherein:

DESCRIPTION OF THE PREFERRED EMBODIMENTS

With reference to the accompanying drawings, a method will be described for forming and heat-treating a workpiece in accordance with the present invention.

Figure 1:
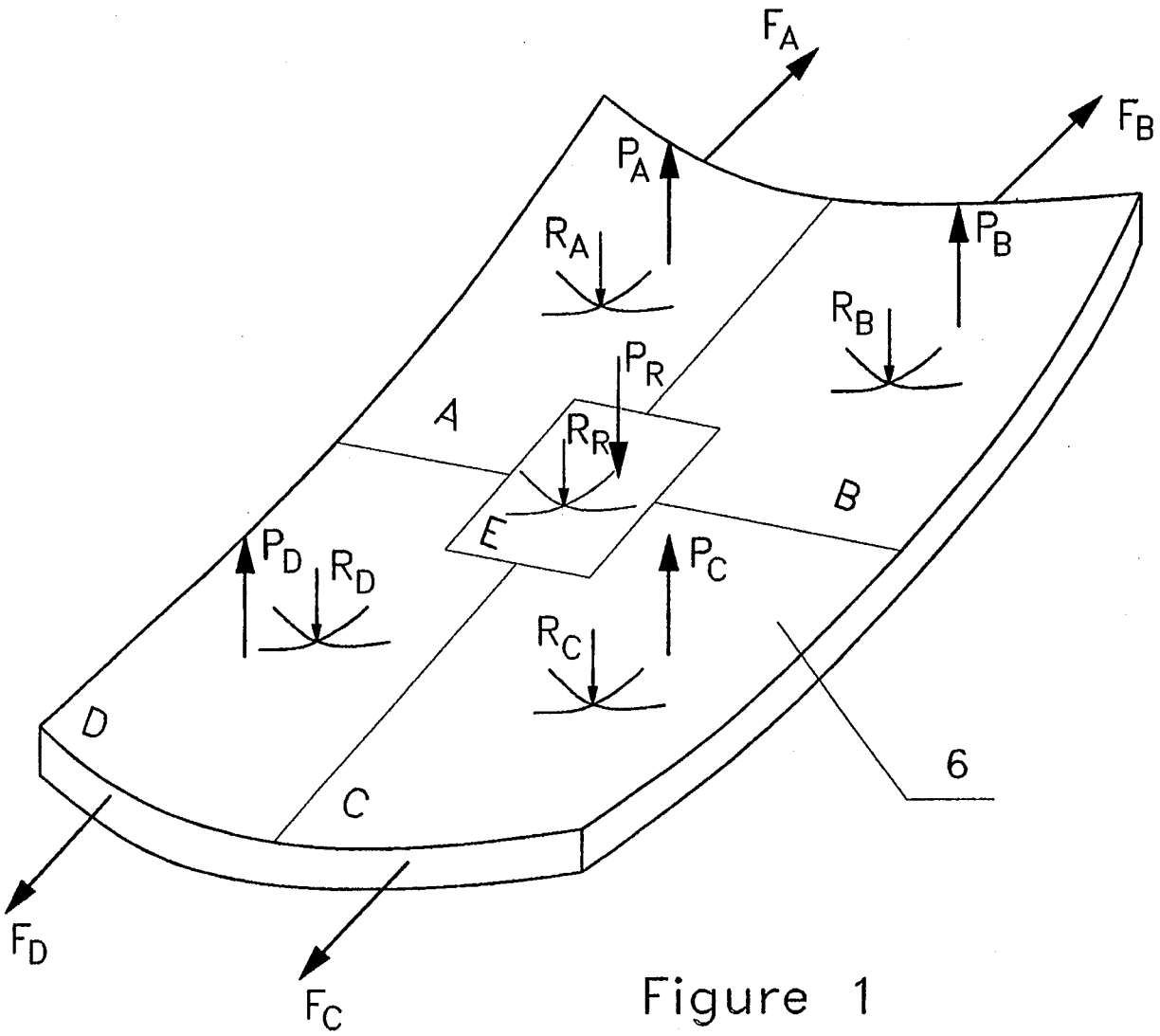
FIG. 1 shows schematically a workpiece of variable-thickness double-curvature monolithic panel type in accordance with the present invention.
Figure 2:
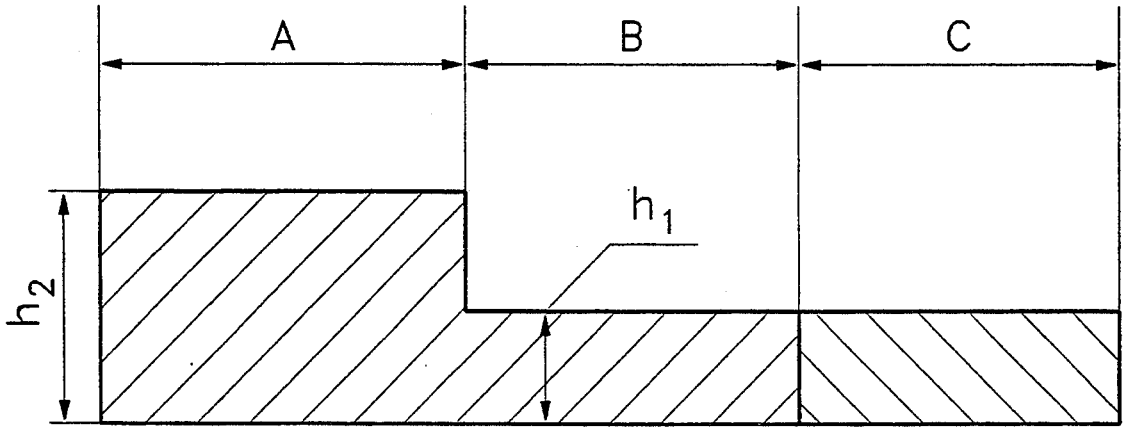
FIG. 2 shows a cross-section of a flat blank made from two materials of different kinds.
Figure 3:
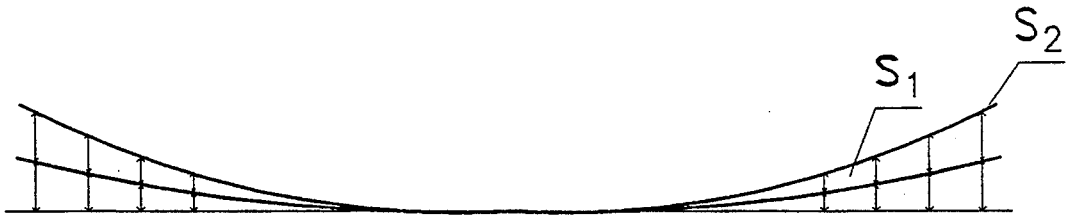
FIG. 3 illustrates a step-by-step variation of the workpiece contour.

A flat blank or a curvilinear blank is subdivided into deforming zones. The dimensions and configurations of these deforming zones are to be selected so that the changes in the curvature and rigidity of the workpiece would not exceed appropriate predetermined values within a single particular zone. FIG. 1 shows five of such deforming zones A, B, C, D, and E. The main curvature radii $R_A$, $R_B$, $R_C$, $R_D$, and $R_E$ vary insignificantly within their appropriate zones. An example of workpiece cross-section shown in FIG. 2 comprises three zones A, B, and C. The workpiece rigidity is the same within each of these zones.

Figure 5:
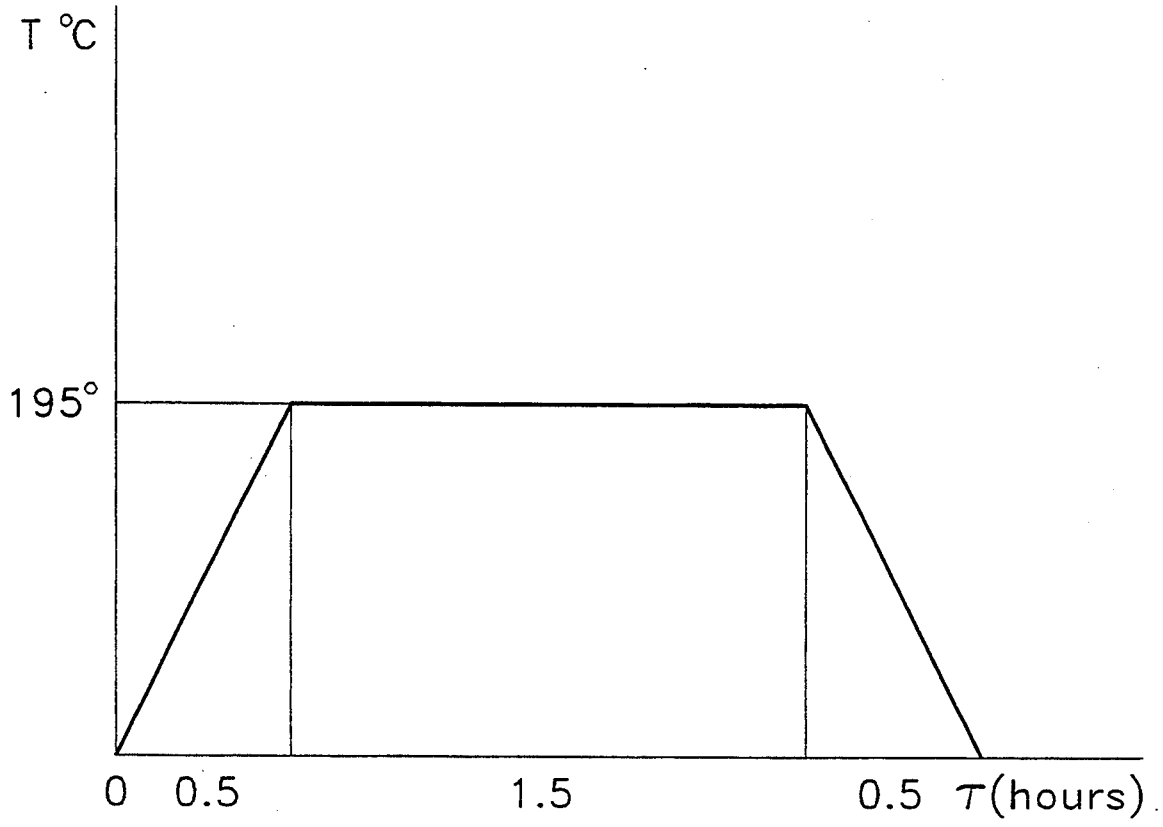
FIG. 5 indicates the heating conditions.

Let us give an example of forming a workpiece from a blank made of aluminum alloy Grade AK-1. The heating conditions are indicated in FIG. 5. The predetermined temperature conditions of heating over various zones is ensured by a heat flow radiated by infrared heaters. A different density of heat flow is predetermined within each zone. The heat flow density is determined in such a manner that the blank temperature would reach 195° C. simultaneously within all the zones in 0.5 hour. If uneven density of heating occurs during heating, the blank should be cooled down to have this unevenness smoothed out. The curvature radius which must be obtained for the finished workpiece after forming is selected to be equal to R=1100 mm.

The maximum deformation required for the outermost fiber is determined from the analysis of the workpiece contour. In this particular case, it can be calculated using the following familiar formula: $\epsilon_{max}=y/R$, where y=workpiece thickness; and R=curvature radius; $\epsilon_{max}=0.8\%$.

Figure 4:
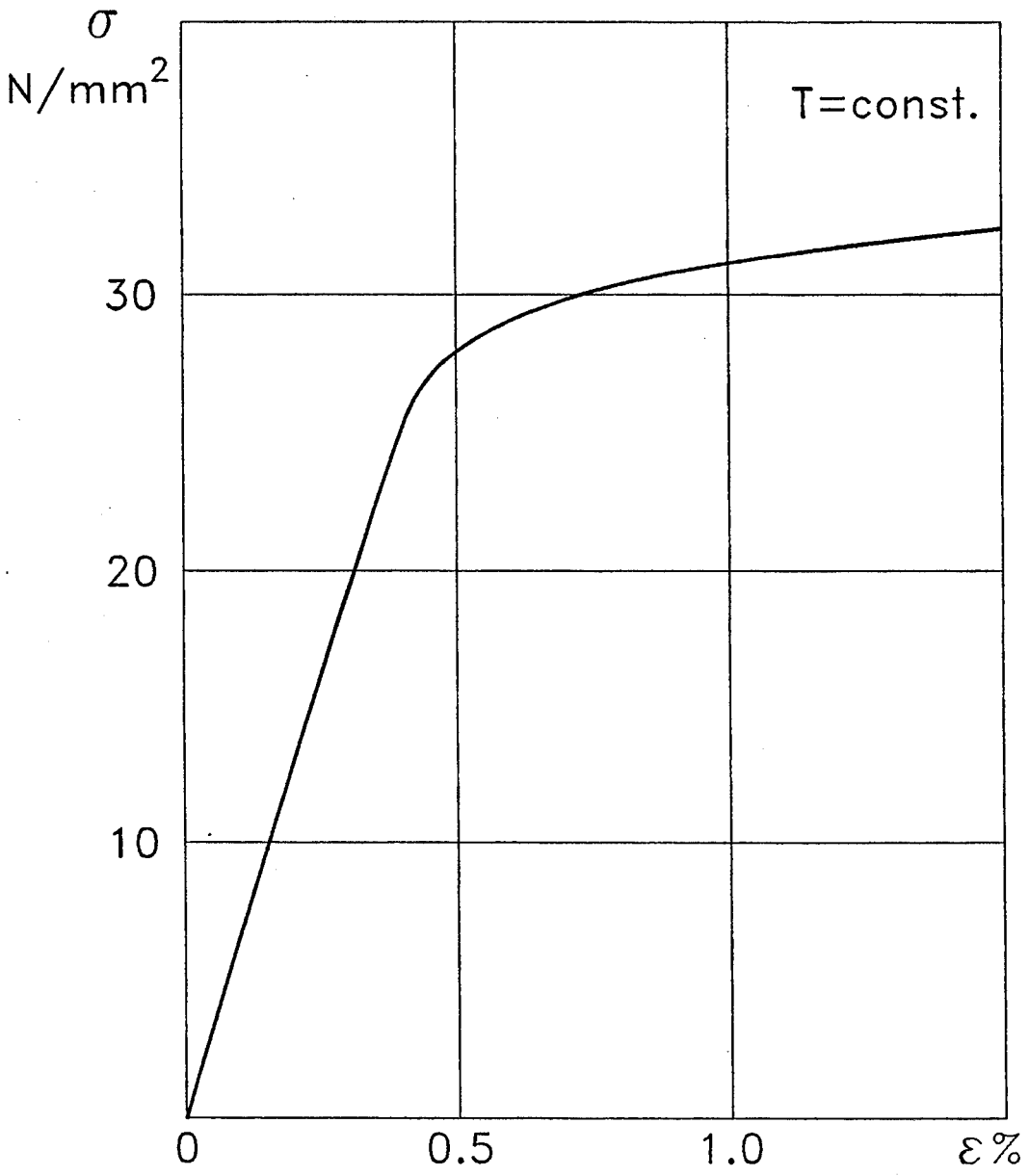
FIG. 4 is a diagram showing the relationship of $\delta$-$\epsilon$.

Realizing the curve of deforming $\delta$-$\epsilon$ (FIG. 4), at 195° C. we determine the portion thereof within-which the relationship between the deformations and stresses is linear, and at this portion we select the value of maximum allowable elastic deformation $\epsilon_e$.

In our case, $\epsilon_e \leqq 0.45\%$, so we select $\epsilon_e=0.4\%$.

The number of deforming steps is determined by us from the following relationship:

$$n = \frac{\epsilon_{max}}{\epsilon_e} = \frac{0.8}{0.4} = 2$$

The process can be subdivided into two steps.

Knowing the curvature of the beam bent axis $$\frac{1}{R} = \frac{M}{J},$$

where M=bending moment; and J=moment of inertia in the cross-section, one can determine the forces that are required as well as the deflections and turning angles at every fixed point for particular calculated radii of curvature at every deforming step. With the blank thickness ratios selected, e.g., for the two zones (FIG. 2) to be $h_1=2$ mm and $h_2=6$ mm, the bending moment $M_2$ for the second zone is 24 times as high as $M_1$.

After the parameters of influence are established for every zone of the blank, they begin to deform the blank step by step. At every step the deformation is carried out both by means of heating and by means of loading under creeping conditions below the limit of elasticity, thus ensuring that plastic deformations will not occur. In order to avoid accumulating the residual stresses in the deforming process, the deforming forces are optimized, for which purpose the rate of deforming is established and varied within every zone in accordance with the emerging stresses. Thus, during temperature strain the deformation rate $\dot{\epsilon}_T$ is changed in proportion to the value of $e^{\alpha T}$, whereas in loading they vary the deformation rate in proportion to the value $k\delta^m$. When both heating and loading are effected at the same time, the deformation rate is $\dot{\epsilon} \approx e^{\alpha T} k\delta^m$, where e=natural logarithm base; $\alpha$=coefficient depending upon the properties of the material used; T=heating temperature; k=coefficient of proportionality; $\delta$=deformation stress; and m=exponent of power.

Under these conditions, one-to-one correspondence is established between the deformation forces and the stresses emerging in the workpiece and the deformation rates at a predetermined temperature within every zone. Hence, by varying the magnitude of force or the temperature within a particular zone, they can vary the deformation rate.

Figure 6:
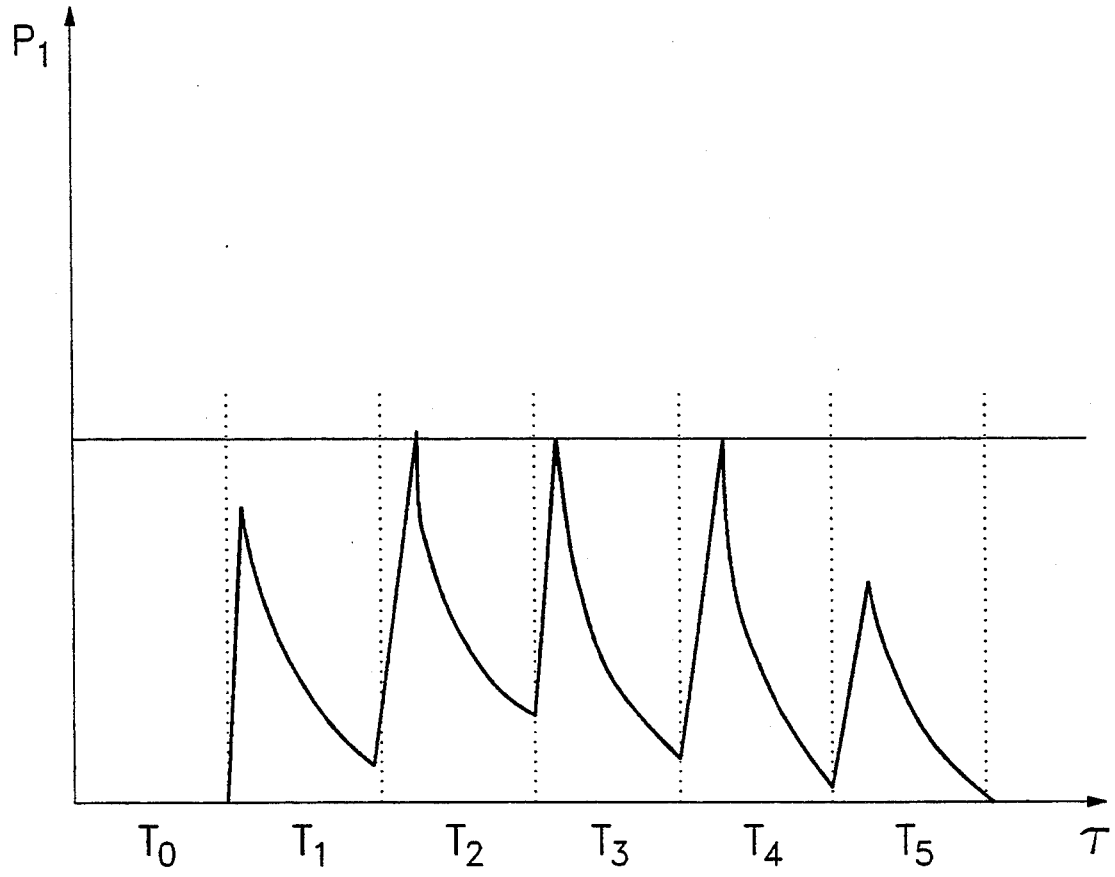
FIG. 6 illustrates the steps of loading and relaxation under the heating conditions.

At the end of a step the value of force is established within each zone which is relaxed to its minimum value (FIG. 6). In our example the time of exposure in the loaded state in accordance with the curve of relaxation for this particular material at the temperature selected to be equal to 195° C. reaches as long as 1.5 hours (FIG. 5). At the end of the last step this force is reduced down to as low as zero (FIG. 6). In the process of relaxation the geometrical dimensions are maintained as obtained at this particular step of deforming the blank. After the last step the blank is subjected to heat treatment and to artificial ageing by cooling it down so that the resulting geometrical dimensions are maintained the same, said dimensions being those ones from which a judgment can be made that the predetermined contour of the workpiece is ready.

As soon as the process of cooling and relieving the loads is over, the resulting shape is checked.

The experiments have shown that the method of forming as described hereinabove allows realizing various kinds of loading the workpiece, i.e., the deforming procedure can be effected by uneven tension, compression and shear in the median surface, and this extends substantially the range of the workpiece shapes that can be obtained.

Since the conditions of forming are optimized, the method according to the present invention allows also to produce the workpieces to any predetermined precision grade so that there is no need to size the workpiece anymore after the process is carried out. Therewith, not only the manual labor is eliminated completely, but also the distortions are prevented that were possible earlier in the micro and macro structures of the material and could lead to a reduction in the service life of the article.

A device is well known in prior art to be used for forming a workpiece under creeping conditions of its material in accordance with U.S. Pat. No. 3,739,617. As it is taught by the above-mentioned patent specification, this device comprises a die, a diaphragm, a heating arrangement and air supply means. The blank is placed on the heatable die and pressed thereto over the entire surface thereof by means of the diaphragm. The loading is effected by blowing air into the diaphragm. The blank is pressed against the die by exposing the entire surface of the blank as a whole to the differential pressure.

It is a disadvantage of this prior art device that in forming a workpiece from a blank having a complicated relief of its surface where there are portions of various rigidities the desirable contour cannot be reached with the suitable precision, whereas some portions thereof are inevitably over-stressed with a resulting destruction of the micro structure during irreversible deformations.

The nearest to the invention now claimed in the technical essence and technical level is a prior art device for forming various workpieces of double curvature under creeping conditions, comprising a thermal chamber provided with upper rods and lower rods arranged to be disposed coaxially therein and provided with fixing units in the form of turnable plates shaped as individual parts of the contour as predetermined for the finished workpiece, said device comprising also individual driving members such as screw-and-nut pairs as well as an electric motor (see, for instance, Inventor's Certificate Specification Serial No. 1147471, Int. Cl. B21D 11/20, i.e., the most relevant prior art).

However, the devices described hereinabove are capable of ensuring only a restricted movement of the parallel rods limited only to one direction—a factor which does not allow controlling the deforming of the blank and limits substantially the range of final configurations attainable for the workpieces thus produced.

Another disadvantage of prior art devices is constituted by low precision attainable in the manufacture of the workpieces. This low precision in forming is caused by the springing action of the workpieces after they are formed to the shape, which springing action cannot have its magnitude taken accurately into account when making the forming equipment because of variations in the mechanical properties shown by the material of blanks and their geometrical dimensions within the tolerable limits.

The third disadvantage consists in that with emerging over-stresses the necessary deformations lead to the distruction of the micro structure of the workpiece material, thereby laying the causes for the future destruction of the article already into the technology of its manufacture.

It is an object of the device now claimed to improve the precision of deforming the workpieces from flat blanks having a complicated relief of their surface as well as to improve their strength and service life by ensuring that the micro structure thereof remains intact while irreversible deformations are being made.

The method according to the present invention can be implemented by using a device for forming various workpieces, comprising a thermal chamber provided with a heater and also with upper rods and lower rods having driving members and connected to the fixing units for fixing the workpiece, wherein, in conformity with the invention now claimed, said thermal chamber is provided additionally with a multisectional housing which is inserted therein and which has the sections thereof connected pivotally with each other and secured to said fixing units arranged to be disposed at the joints of the sections, said heater being therewith arranged to be disposed in each of said sections, whereas each of said sections is provided with a cooling arrangement inserted therein, and in each of said sections those portions of the workpiece are to be positioned which constitute essentially heating zones, cooling zones and loading zones, said fixing units for fixing the workpiece are provided with spherical pivots through which said fixing units are connected to the driving rods made in the form of hydraulic cylinders attached to the frame of said thermal chamber so that they are swivellable therein, said fixing units serving therewith as the places for applying the loading forces thereto so that they are capable of being moved in accordance with deformation of the workpiece. The device according to the present invention can be understood from the accompanying drawings.

Now with reference to the accompanying drawings (FIG. 7), the device for the manufacture of the workpieces in accordance with the present invention comprises a thermal chamber 1 provided with a supporting frame on which a heater 2 is arranged to be disposed, said device also comprising driving members 3 with upper and lower rods 4 connected to fixing units 5 for fixing a workpiece 6. What is novel here is that the thermal chamber 1 is provided additionally with a multisectional housing 7 which is inserted therein and which has a plurality of sections 8 connected pivotally with each other and secured to the fixing units 5, that the heater 2 has therewith its sections arranged to be disposed and fixed in each of the sections 8, whereas each of these sections is provided with a cooling arrangement 9 inserted therein, that in each of the above-mentioned sections those portions of the workpiece 6 are to be positioned which constitute essentially heating zones and cooling zones, that there are also loading zones defined by the fixing units 5 designed for fixing the workpiece 6, and that the fixing units 5 are provided with spherical pivots 10 through which these fixing units are connected to the rods 4 of the drives made in the form of hydraulic cylinders 3 attached to the frame of the thermal chamber so that they are capable of being swivelled therein, the fixing units 5 serving therewith as the places for applying the loading forces thereto so that they are capable of being moved in accordance to the deformation inflicted to the workpiece 6.

Figure 7:
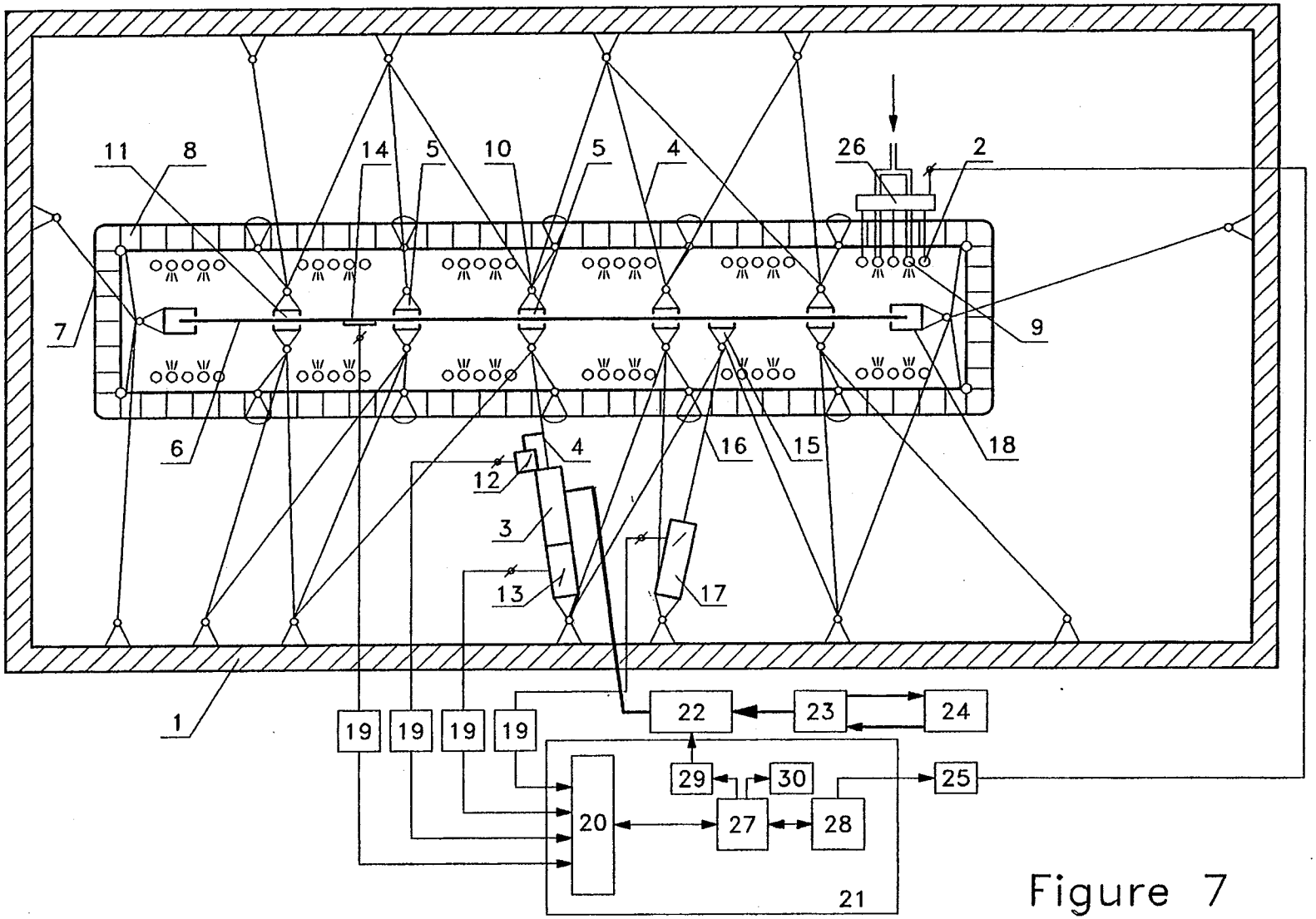
FIG. 7 is a schematic diagram of a device for effecting the method in accordance with the present invention, said device being shown in its initial position.
Figure 8:
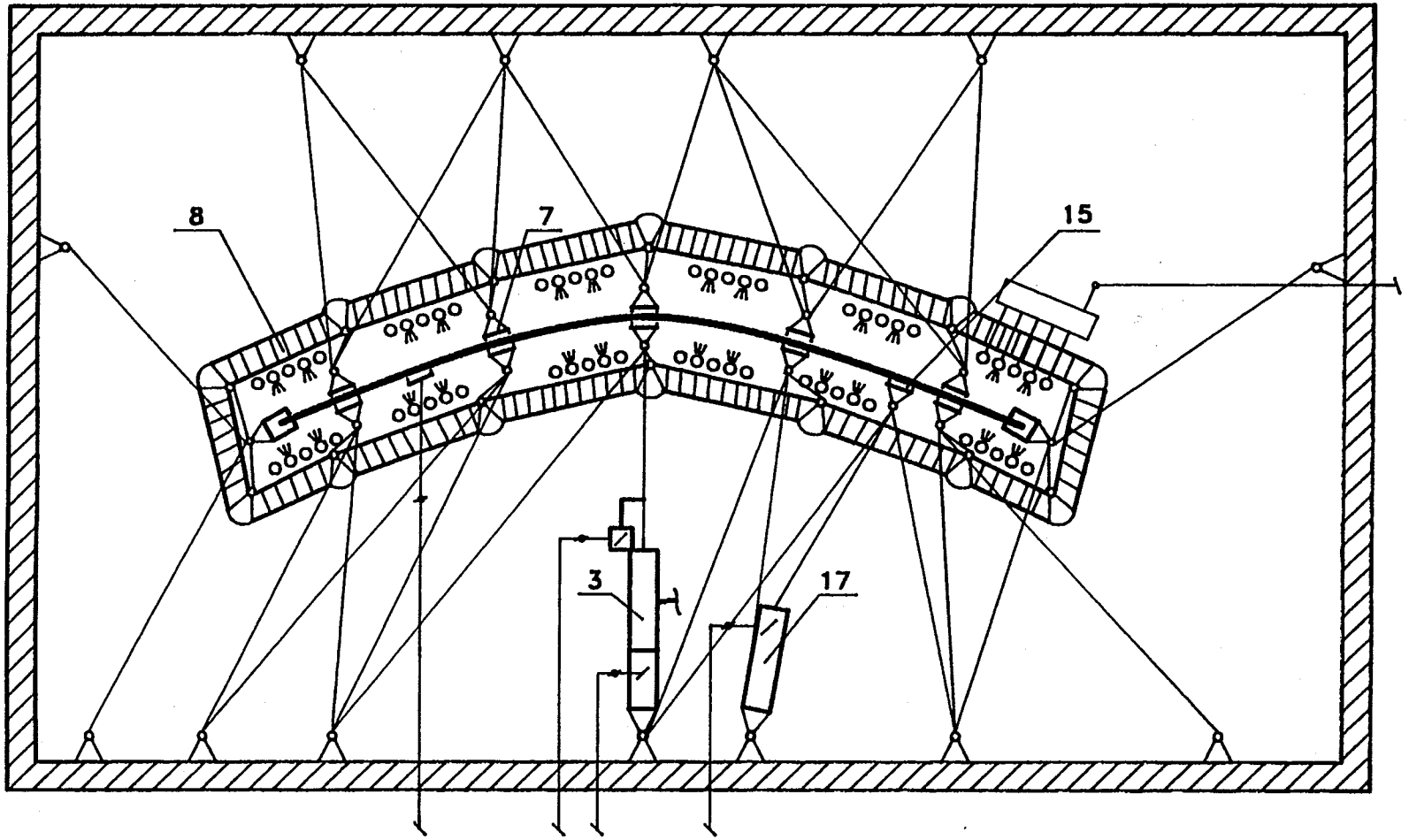
FIG. 8 shows the same, but when the device is in its working position.

In addition to this, the reference numerals used in FIGS. 7 and 8 have the following meanings: the fixing unit 5 is provided with a plate 11, the hydraulic cylinders 3 comprise displacement transducers 12 and load gauges 13 and they are attached to the frame of the thermal chamber so that they are capable of being swivelled therein. Each of the sections is provided with a sensor 14 for measuring the temperature and relative deformations therein as well as with a displacement measuring unit 15. The latter consists of a spherical pivot with a plate, wherein rods 16 of linear displacement transducers 17 attached pivotally to the wall of the thermal chamber 1 are secured. The multisectional housing is provided with grips 18 at the ends thereof for gripping the workpiece 6 thereby.

All the sensing elements have their outputs connected through normalizers 19 to the appropriate inputs of analog-to-digital converter 20 of a control computing device 21. The outputs of the control computing device 21 are connected to an electrohydraulic commutator 22 and to an electrohydraulic transducer 23 which has the pressure and drain pipelines thereof connected to an oil pumping unit 24. Another output of the control computing device is connected to electric-power thyristor controllers 25 joined to bus-bars 26 to which the infrared sources 2 are connected.

For simplicity, FIG. 7 shows schematically only one thyristor controller, one hydraulic cylinder and one displacement transducer, whereas the positions of all the other elements are indicated by lines.

The control computing device 21 comprises, besides the multichannel analog-to-digital converter 20, also a micro computer 27, a multichannel digital-to-analog converter 28, output means 29 for reading out the digitized signals, and a control element 30 for controlling the thyristors.

The device for forming the workpieces in accordance with the present invention operates as follows (FIG. 7 and FIG. 8).

The multisectional housing 7 is set by means of the rods 4 of the hydraulic cylinders 3 into its initial, for instance, horizontal position so that a clearance is thus ensured in between the fixing units of the upper and lower rods. Then a workpiece 6 is inserted into this clearance and clamped therein by means of the hydraulic cylinder rods. The displacement measuring units 15 of the linear displacement transducers 17 and the sensors 14 for measuring the temperature and relative deformations are mounted to the workpiece.

The data related to the final configuration of the workpiece, to the allowable values of stresses, to the relative deformations, forces, displacements and temperatures and also to the time schedule of heating up and deforming the workpiece as well as such data characterizing this particular installation and necessary for shaping up the control influences as the coordinates of workpiece fixing points and hydraulic cylinder-to-thermal chamber frame attachment points, the calibration characteristics of sensing elements, the number of zones under control, their addresses, etc. are set into the control computing device 21.

In conformity with a heating time schedule, the control computing device 21 regulates the heating temperature of the workpiece 6 within the specified zones, using the thyristor controllers 25 to meter the electric power supplied to the infrared sources 2. In doing so, use is made of the feedback ensured by the temperature sensors 14.

As soon as the predetermined distribution of temperatures is reached throughout the workpiece 6, the control computing device 21 will load and deform the workpiece 6 with rods 4 of the hydraulic cylinders 3 in accordance with the predetermined program.

The design of the device now claimed makes it possible to ensure the three-dimensional loading and deformation of the blank due to that several push rods of hydraulic cylinders are united in a single fixing unit through the spherical pivot. Thus, in particular, if the push rods of three hydraulic cylinders are united in a fixing unit, it becomes possible to control one normal component of the load and two tangential components of the load as applied to the workpiece.

The displacements of the workpiece are monitored by the linear displacement transducers 17. If as many as up to three rods of linear displacement transducers are united in a single measuring unit through a spherical pivot, it becomes possible to take the measurements of the normal component and two tangential components of the workpiece displacement. These data are sent through the normalizers 19 and the multichannel analog-to-digital converter 20 to the micro computer 27 which compares the workpiece position against those specified in accordance with the program. In case if the error exceeds the allowable value, the micro computer 27 sends appropriate signals to the multichannel analog-to-digital converter 28 and the digitized-signal output means 29 to control the forces developed and the displacements travelled by the push rods 8 of the hydraulic cylinders by means of the electrohydraulic transducer 23 to which the hydraulic cylinders 3 are connected in turn through the electrohydraulic commutator 22. Then, the workpiece thus formed is cooled down by means of the cooling arrangement 9. Every time this occurs, the fixing units maintain the resulting workpiece configuration. The process of forming is terminated as soon as the workpiece reaches its predetermined configuration (FIG. 8).

Thus, the device now claimed ensures the opportunity for independent three-dimensional application of forces and moments, including the forces of tension/-compression applied to the workpiece in the median plane, and this opportunity allows deforming of the workpieces of complicated configuration with large deflections.

This extends the range of the final configurations thus attainable as well as the range of workpiece types that can be manufactured in accordance with this technology. Since the forces applied and the displacements obtained are monitored and controlled, the process of forming can be adapted to the mechanical properties of each particular workpiece. The forming conditions can be optimized at every fixed point so that the workpiece produced in this manner more precisely conform to the predetermined configuration. This in turn reduces the number of workpiece rejects. In addition to this, the independent regulation of loads and temperatures in some zones to ensure the desirable configuration of the workpiece allows reducing of the manufacturing costs related to the manufacture of equipment for a particular workpiece together with the adjustment of this equipment that is to follow thereafter.

In the case when very large deflections and displacements of the blank take place while the workpiece is being formed, it seems reasonable to make use of a modified device for effecting the method described above.

In this implementation the thermal chamber frame itself is made in the form of a multisectional housing, some sections of the housing being therewith provided with drives for the displacement thereof in the space, the housing sections of the thermal chamber frame are provided with drives mounted thereto and having rods for loading and deforming the blank directly, each of the sections is provided with heaters and cooling arrangements, whereas the sections are connected with each other by means of pivots.

Figure 9:
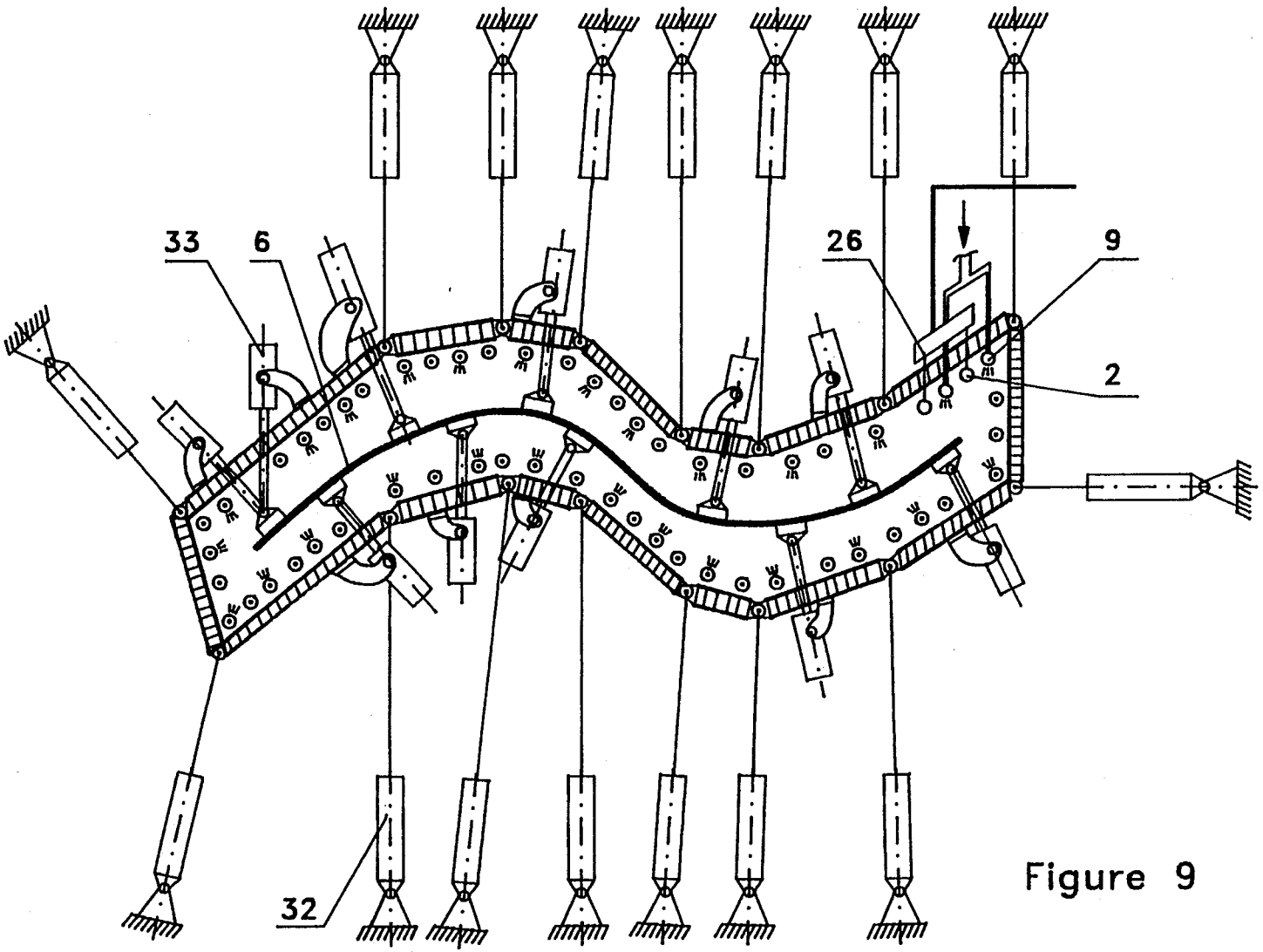
FIG. 9 is a schematic diagram of a device for effecting large deflections in accordance with the present invention.

FIG. 9 illustrates such a device for forming a workpiece with large deflections of the blank.

The housing of the thermal chamber frame consists of sections 31 provided with drives 32. The sections 31 are provided with local short-travel loading devices (or drives) 33 which are attached thereto and which deform the blank of workpiece 6 directly each within its own zone. The sections 31 are also provided with heaters 2 and cooling arrangements 9 attached thereto. The drives 32 and 33 are provided with displacement transducers and load gauges, and they are connected to the system of control over the process of forming in the same manner as the drives 3 in FIG. 7.

The process of forming is carried out in accordance with the process described hereinabove, the loading being carried out within each of the zones by the local short-travel drives 33 within the ranges of their possible travels, whereas the control system 21 compensates for the inadequate rod travel of the local drives 33 by means of moving the sections 31 in the space by the drives 32 so that the sections 31 are positioned equidistantly with respect to the curved surface of the blank of the workpiece 6. Such a design of the device according to the present invention allows carrying out forming of the workpieces with rather large deflections of the blank. In addition to this, the loads are transmitted to the workpiece in a simpler manner, and the drives can operate easier within the hot zone since only short-travel drives are used here and the direction in which the forces exerted by these local drives are acting will change insignificantly in the process of forming the workpiece.

Where the workpieces to be formed have double curvature with large deflections, the sections 31 may feature a triangular or polygonal configuration in the plan view, thus forming a plurality of approximating flat elements incorporated into a three-dimensional configuration (or a grid), wherein the pivots connecting the sections with each other serve as the units.

Figure 10:
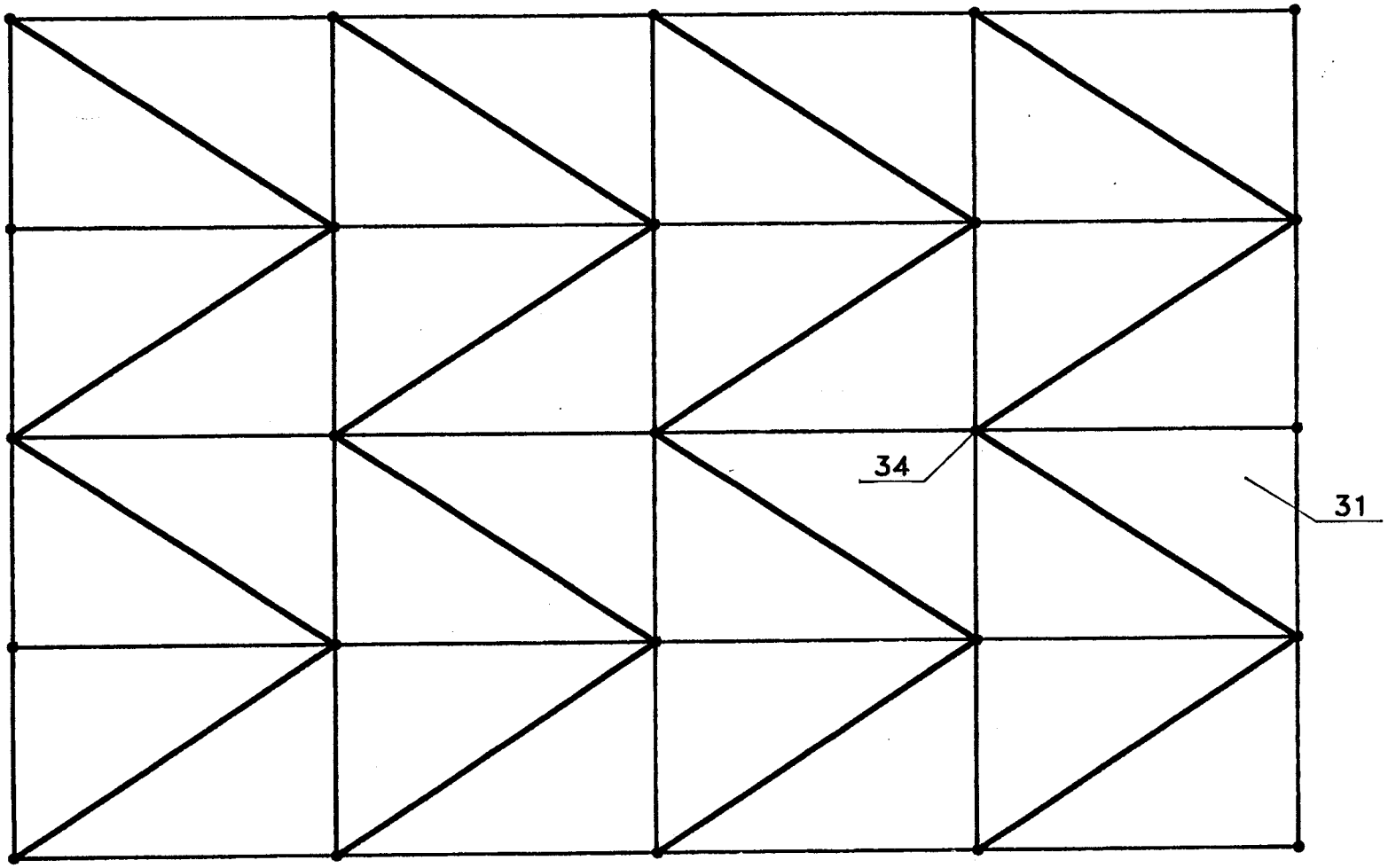
FIG. 10 illustrates a triangular-shaped section of a multisectional housing.

FIG. 10 shows a layout of the sections 31 having a triangular configuration in the plan view and intended for forming a workpiece having a rectangular configuration in the plan view. The sections 31 can be connected with each other by means of spherical pivots 34. In the most general case for an all-purpose device it is necessary to provide as many pivots 34 and drives 32 for moving the sections 31 as possible so that it would be possible to connect the pivots 34 and the drives 32 as required for working with a particular workpiece 6 depending upon the configuration class of these workpieces.

What is claimed is:

1. A method for creep forming a workpiece comprising the steps of:

synchronously heating and cooling a plurality of selected areas of the workpiece from both sides of the workpiece;

displacement forming the workpiece by applying an individual forming force to each of the selected areas and from both sides of the workpiece;

monitoring and controlling the magnitude of the forming forces;

halting the displacement forming in an area of the workpiece where the forming force has reached a predetermined maximum level;

during the halting step maintaining a constant displacement of the workpiece until the magnitudes of all individual forming forces are reduced to a predescribed minimum level; and thereafter repeating the displacement forming, halting and maintaining steps until the workpiece has been completely displacement formed and reached its desired shape.

2. A method according to claim 1 wherein the maintaining step comprises the step of reducing at least some of the forming forces during the halting step.

3. A method according to claim 2 wherein the reducing step comprises reducing all forming forces during the halting step.

4. A method according to claim 1 wherein the step of heating comprises the step of individually heating each selected workpiece area.

5. A method according to claim 1 wherein the cooling step comprises individually cooling at least some of the selected workpiece areas.

6. A method according to claim 5 wherein the cooling step is performed during the halting step.

7. A method according to claim 5 including the step of cooling at least some of the selected areas following the heating step and prior to the forming step to thereby equalize the temperature of the selected areas.

8. A method according to claim 5 including the step of cooling the selected areas following the last maintaining step to thereby heat treat and artificially age the workpiece.

9. A method according to claim 1 wherein the halting step comprises individually halting the displacement forming for each of the selected workpiece areas.

10. A method according to claim 1 wherein each workpiece area is assigned a forming force of a preprogrammed magnitude, and including the step of increasing the temperature of a workpiece area in which the monitored forming forces are smaller than the preprogrammed magnitude of the forming force, the step of increasing the temperature being performed during the halting step.

11. A method according to claim 1 wherein the monitoring step includes monitoring the temperature of the workpiece areas during the halting step, and including the step of decreasing the temperature of workpiece areas where the forming forces decline faster than a preprogrammed, preestablished rate of decline during the halting step.

12. A method for creep forming a workpiece comprising the steps of:

synchronously heating and cooling a plurality of selected areas of the workpiece from both sides of the workpiece;

displacement forming the workpiece by applying an individual forming force to each of the selected areas and from both sides of the workpiece;

monitoring and controlling the magnitude of the forming forces;

halting the displacement forming in an area of the workpiece where the forming force has reached a predetermined maximum level;

during the halting step maintaining previously formed deformations of the workpiece areas until all forming forces reach a preestablished minimum level; and thereafter repeating the displacement forming, halting and maintaining steps until the workpiece has been completely displacement formed and reached its desired shape.

13. Apparatus for deforming a workpiece having a plurality of areas distributed over its main surfaces, the apparatus comprising:

a multisectional housing formed of individual housing sections, and hinge means pivotally connecting the sections, a plurality of sections being stationary and a remainder of the sections being movable about the hinge means, the sections defining first and second, spatially flat faces which are equidistant from the main surfaces of the workpiece when a workpiece is mounted inside the housing;

an individual displacement drive connected to each movable section for moving the movable sections;

force actuators mounted for acting on the workpiece disposed inside the housing, each force actuator including a workpiece displacement transducer and a load transducer installed at an end thereof which is relatively remote from the workpiece;

forming force drive control means for controlling the forming force actuators and operatively connected with the displacement and forming force transducers; and means located at fixed positions on the housing sections for regulating the temperature of the workpiece areas in the housing sections.

14. Apparatus according to claim 13 wherein the regulating means comprises means for heating the workpiece area in the associated housing section.

15. Apparatus according to claim 13 wherein the regulating means includes means for cooling the workpiece area in the associated housing section.

* * * * *